United States Patent [19]

Sangati

[11] Patent Number: 4,572,441

[45] Date of Patent: Feb. 25, 1986

[54] PNEUMATIC CONTROL SYSTEM FOR GRINDING MILL

[75] Inventor: Guido Sangati, Padua, Italy

[73] Assignee: Sangati S.p.A., Padua, Italy

[21] Appl. No.: 587,935

[22] Filed: Mar. 9, 1984

[30] Foreign Application Priority Data

Mar. 10, 1983 [IT] Italy ..... 19998 A/83

[51] Int. Cl.[4] ..... B02C 25/00

[52] U.S. Cl. ..... 241/34; 241/135; 241/143

[58] Field of Search ..... 241/34, 37, 135, 143

[56] References Cited

U.S. PATENT DOCUMENTS 4,442,980 4/1984 Oetiker et al. ..... 241/34

*Primary Examiner*—Mark Rosenbaum

*Attorney, Agent, or Firm*—Karl F. Ross; Herbert Dubno

[57] ABSTRACT

A mill for grinding farinaceous seeds into flour comprises a pair of counterrotating cylinders to which seeds to be ground are fed from a hopper with the aid of a transport roller. A float inside the hopper detects the level of a supply of seeds present therein and, via a pneumatic controller, varies the position of a curved cover plate confronting the transport roller in order to change the width of the intervening gap in conformity with the seed level. When the float descends to a minimum level, the gap is closed completely and the cylinders, arrested together with the transport roller, are separated from each other.

7 Claims, 3 Drawing Figures

PNEUMATIC CONTROL SYSTEM FOR GRINDING MILL

FIELD OF THE INVENTION

My present invention relates to a grinding mill designed to convert farinaceous seeds into flour.

BACKGROUND OF THE INVENTION

In conventional grinding mills the seeds or grains to be ground are loaded into a hopper from whose outlet they are extracted by a transport roller and/or a feed-screw for delivery to the nip of two counterrotating main rolls or cylinders between which they are comminuted. On their way to these grinding cylinders the grains move through a narrow passage which is bounded on one side by a curved cover plate whose spacing from a fixed countersurface is controlled—e.g. hydraulically—by a seed-level detector such as a float located in the hopper. Since the reloading of the hopper generally takes place only at intervals, the level of the granular mass therein is subjected to considerable variations and may, in fact, go to zero when the contents of the hopper are depleted. In such a case, the detector should separate the two counterrotating cylinders from each other in order to prevent them from coming into direct grinding contact; at the same time, the detector arrests the transport roller and moves the cover plate onto the countersurface in order to block the passage of grain therethrough until the hopper has been refilled whereupon the cylinders can be restored to their operating position.

In order to let the mill operate as efficiently as possible with changing loads the detector may also cause a shifting of the cover plate during normal operation so as to vary the width of the passage in a manner generally proportional to the seed level in the hopper. This is meant to maintain a substantially constant density of the mass to be ground.

In my copending application Ser. No. 583,931, filed Feb. 27, 1984, I have disclosed a grinding mill of this general type wherein, with the cover plate remaining stationary during operation, a transport roller of variable velocity lies in cascade with a distributing roller corotating therewith at substantially the same peripheral speed in guiding the oncoming grains to the grinding cylinders. As more particularly illustrated and described in that prior application, the detector controlling the roller speed is designed as a capacitive level sensor rather than as a mechanical float.

OBJECT OF THE INVENTION

The object of my present invention is to provide simple and effective means for controlling the operation of a grinding mill of the type first described, provided with a displaceable cover plate, so as to vary the width of the aforementioned passage in a smooth and continuous manner in response to level changes ascertained by a detector.

SUMMARY OF THE INVENTION

I realize this object, in accordance with my present invention, with the aid of pneumatic means controlled by the detector and linked with the cover plate for displacing same with reference to the transport roller confronted thereby to vary the width of an intervening gap representing the passage referred to.

In principle, the detector coacting with the pneumatic means could be a capacitive level sensor such as the one disclosed in my above-identified copending application. I prefer, however, to use a purely mechanical/pneumatic system by using a float-type detector carried by the seeds in the hopper.

Advantageously, the pneumatic means coupling the level detector with the movable cover plate include a servomotor fluidically controlled by a pilot valve which in turn responds to the position of the detector. By way of further refinement, designed to minimize the reactions which a relatively weak setting force such as that exerted by a float must overcome and thus to enhance the sensitivity of the system, I prefer to interpose an ancillary valve between the pilot valve and the servomotor; the latter, according to the embodiment more particularly described hereinafter, may comprise a double-acting cylinder whose piston is linked at one end with the movable cover plate and bears by its other end upon a biasing spring which urges the body of the ancillary valve toward one position (generally that in which the servomotor completely closes the gap between the cover plate and the transport roller) while air pressure from the pilot valve, modulated under the control of the level detector, tends to displace that body into an opposite position. When the float descends to its lowest level, that modulated pressure is cut off and the gap closes, with concurrent arrestation of a common drive motor for the cylinders and the transport roller as well as separation of the cylinders from each other.

BRIEF DESCRIPTION OF THE DRAWING

The above and other features of my present invention will now be described in detail with reference to the accompanying drawing in which.

SPECIFIC DESCRIPTION

Figure 1:
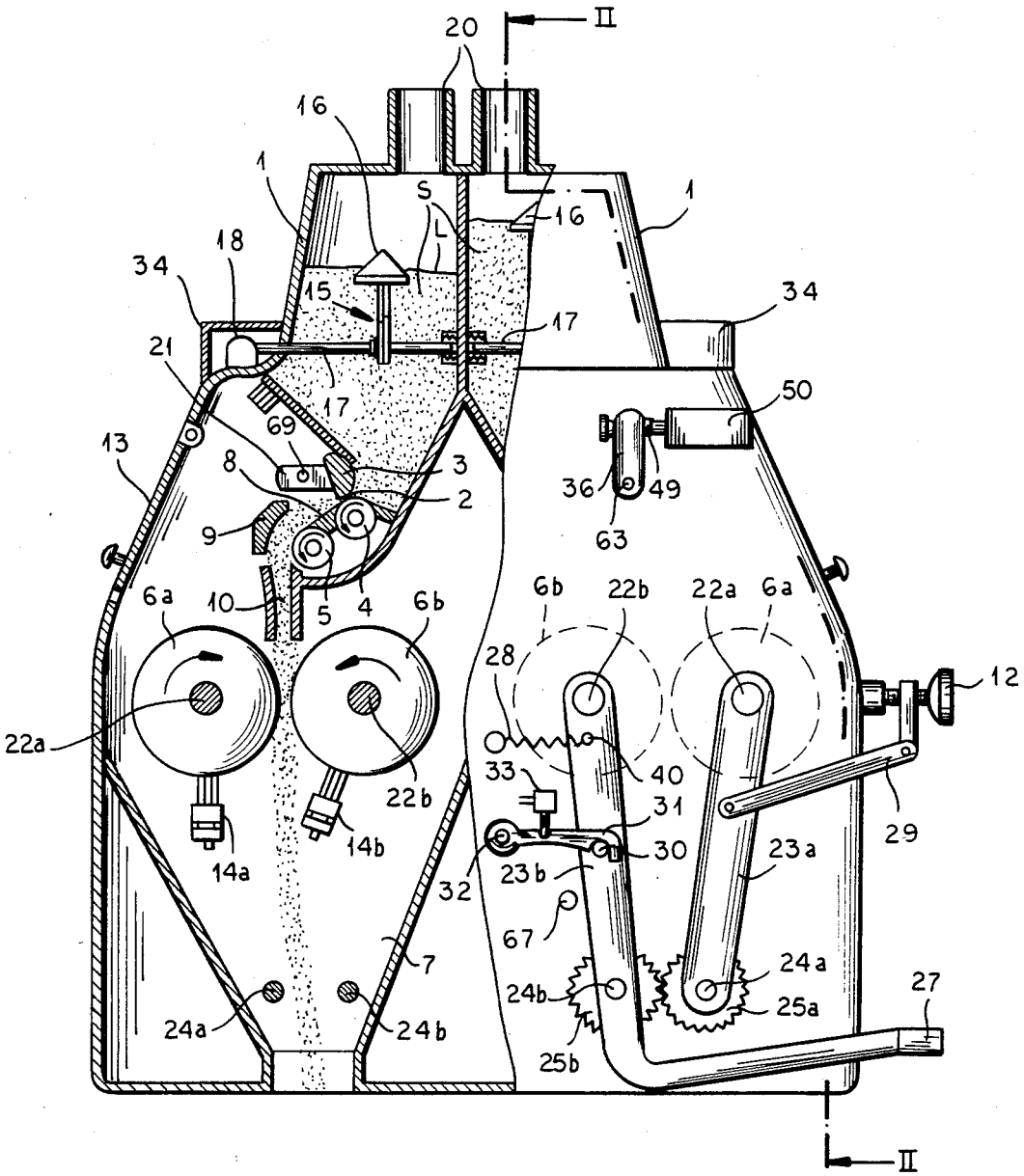
FIG. 1 is an elevational view, with parts broken away, of a grinding mill embodying a control system according to my invention.
Figure 2:
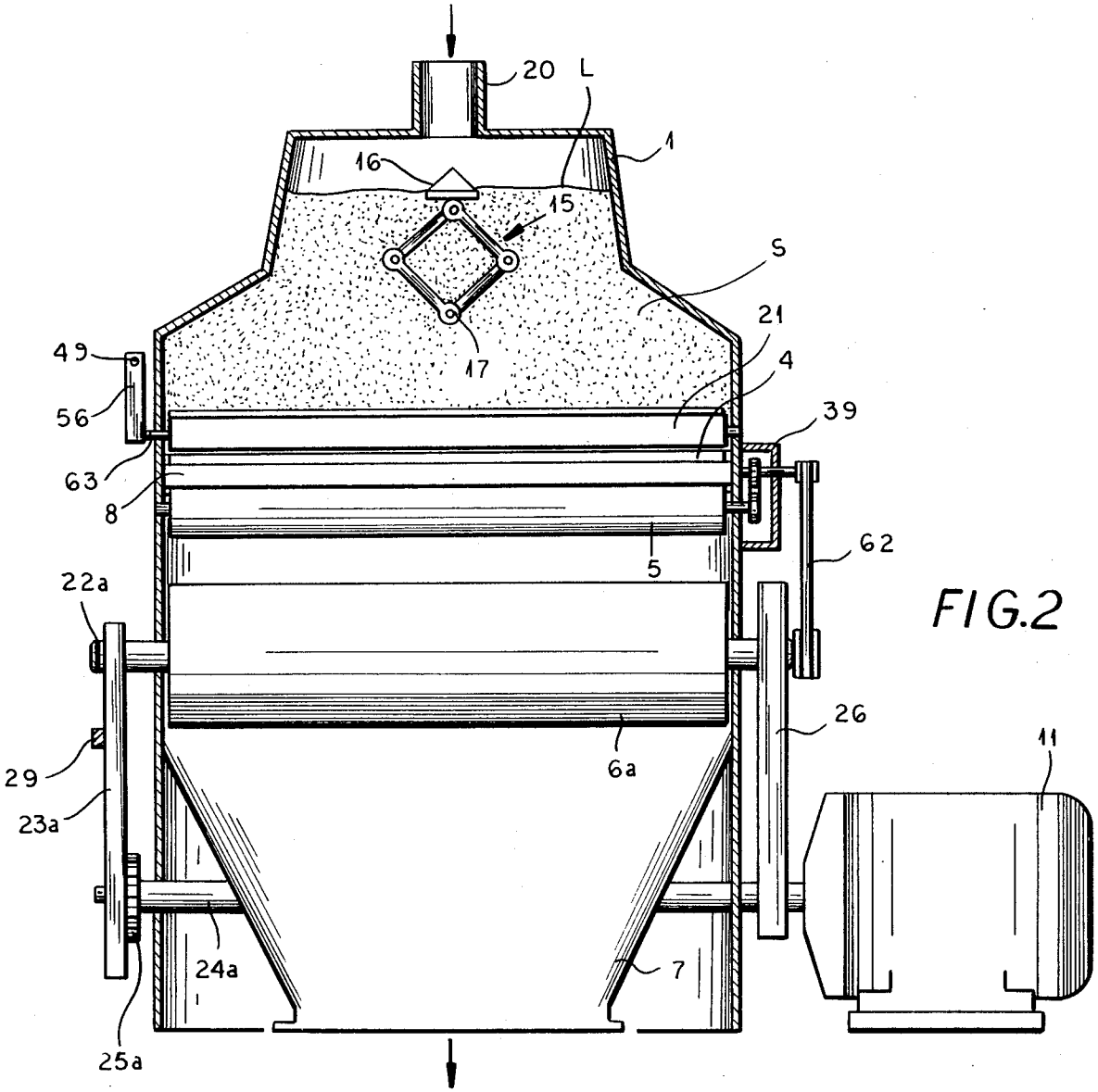
FIG. 2 is a cross-sectional view taken on the line II—II of FIG. 1.

The grinding mill shown in FIGS. 1 and 2 is divided into two symmetrical halves of identical structure so that only one of the duplicated components needs to be described in each instance. These components include, for each half, a hopper 1 loadable through an inlet 20 and provided with an outlet gap 2 bounded by a movable cover plate 3 and by a normally rotating transport roller 4. A guide plate 8 directs seeds S to be ground, loaded into hopper 1, into a somewhat wider passage bounded by a stationary deflector 9 and by a distributing roller 5 corotating (counterclockwise in the left-hand half of FIG. 1) with roller 4 at substantially the same, possibly slightly higher peripheral speed. Roller 5 feeds the oncoming seeds into a channel 10 terminating at the nip of a pair of counterrotating grinding cylinders **6*a*, 6*b* by which they are comminuted and delivered as flour to an outlet of a discharge funnel 7**.

The compartment containing rollers 4, 5 and grinding cylinders **6*a*, 6*b* is accessible through a door 13 enabling the position of deflector 9 to be manually adjusted with the aid of nonillustrated means. The two cylinders are continuously scraped by brushes 14*a*, 14*b***.

Cylinders **6*a*, 6*b* are keyed to respective shafts 22*a*, 22*b* whose opposite extremities are journaled in the free upper ends of two pairs of arms 23***a*, 23*b* which are swingable at their lower ends about another pair of shafts 24*a*, 24*b*. Shaft 24*a*, driven by a motor 11, carries a gear 25*a* in mesh with another gear 25*b* on companion shaft 24*a* whereby the two shafts counterrotate; each shaft is connected through a respective chain or belt transmission 26 (only one shown) with the associated cylinder shaft 22*a*, 22*b* for entraining same.

Arm 23*b* is integral with a pedal 27 enabling it to be swung clockwise about its pivot shaft 24*b* against the force of a spring 28 which is anchored thereto at 40 and tends to separate the cylinder 6*b* from cylinder 6*a*; the position of the latter is manually adjustable by a handwheel 12 connected by a link 29 with arm 23*a*. A detent 30 on arm 23*b* coacts with a latch 31, swingable about a pivot 32, in order to arrest the arm 23*b* in a position in which cylinder 6*b* approaches cylinder 6*a* to the extent determined by the setting of handwheel 12. Arm 23*b* can be unlatched by a normally de-energized solenoid 33.

Each hopper 1 is provided with a respective float 16 serving to sense the level L of its seed charge S. A pantograph-type linkage 15, with upper limbs articulated to the associated float and with lower limbs swingable on a horizontal shaft 17 which is keyed to one of these lower limbs (the left one in FIG. 2), translates a rise and a fall of the float into a rotation of shaft 17 in one or the other direction. With the arrangement shown in FIG. 2, a descent of float 16 results in a counterclockwise rotation of shaft 17. The two shafts 17 seen in FIG. 1, associated with respective floats 16 seen to lie at different levels, are of course independent of each other.

Each shaft 17 extends through a lateral wall of its hopper 1 into a respective box 34 to act upon a pilot valve 18, formng part of a pneumatic control system, as more fully described hereinafter with reference to FIG. 3. Another part of that system, contained in a box 50, converts the rotation of shaft 17 into a proportional but smaller rotation of a shaft 63 which is journaled in the front and rear walls of the mill housing and carries a pivot bar 21 to which the cover plate 3 is attached. With reference to the plate 3 visible in FIG. 1 and controlled by the left-hand float 16, a lowering of that float results in a clockwise rotation of bar 21 to narrow the gap 2 between plate 3 and roller 4.

As seen at right in FIG. 1, shaft 8 is keyed to an arm 56 which is connected with a piston rod 49, forming part of a pneumatic servomotor 48 (FIG. 3) in box 50, retracted inward when the seed level L in the corresponding hopper is high so as to swing that arm counterclockwise as the associated float 16 descends. It should be noted that the same arm 56 has been shown in FIG. 3 in its opposite limiting position, attained when the associated float 16 has descended to its lowest level.

Figure 3:
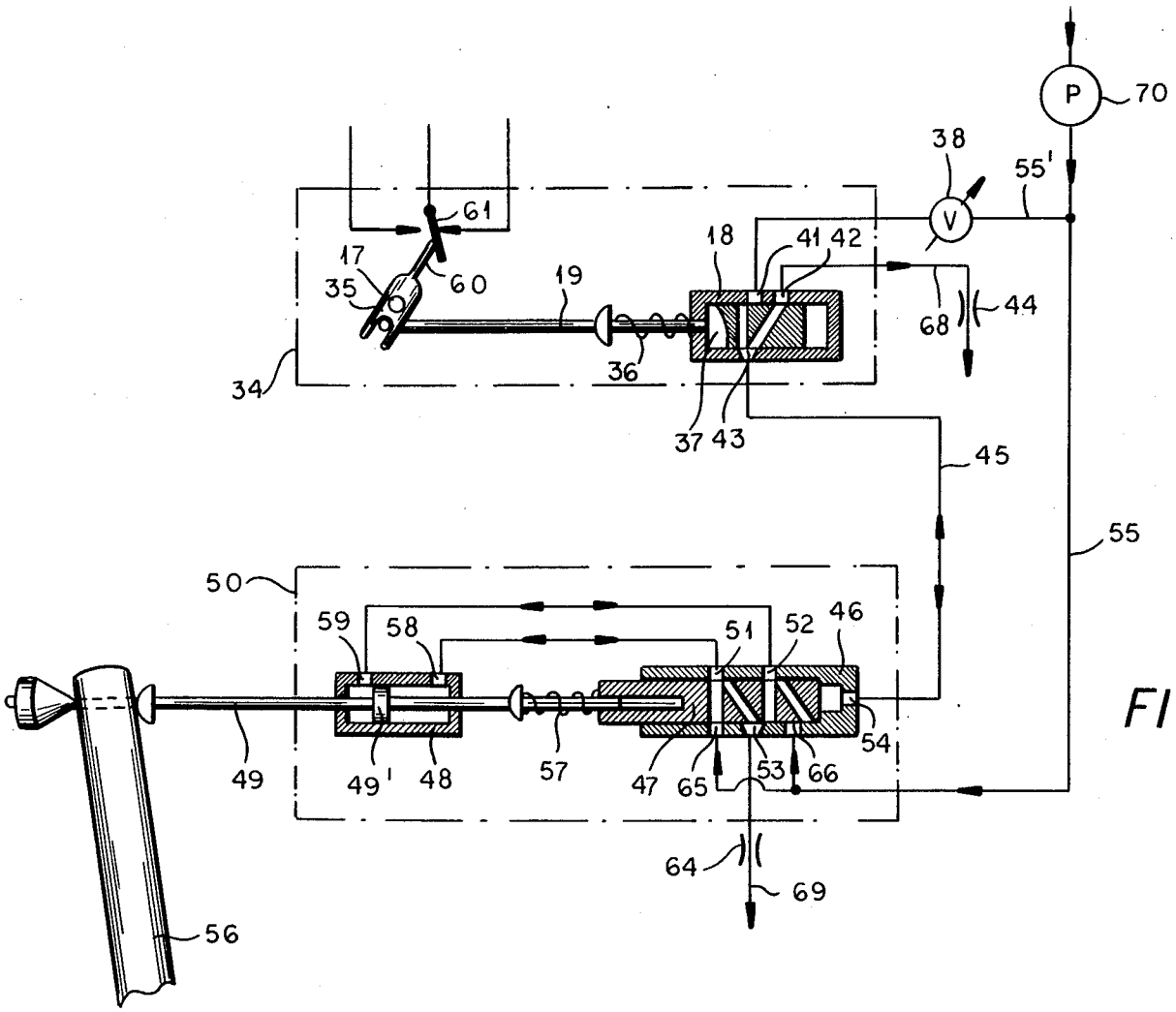
FIG. 3 is a diagram of the pneumatic circuit of the control system.

A lever 35 inside box 34, keyed to shaft 17 as shown in FIG. 3, is mechanically linked with a rod 19 attached to a slidable body 37 of pilot valve 18. A weak spring 36 urges the valve body 37 and the lever 35 into the illustrated terminal position corresponding to a minimum seed level L in the associated hopper 1. In this position the valve 18 cuts off a flow of air from a high-pressure pump or blower 70, from which a branch 55' of a conduit 55 extends through an adjustable pressure-reducing valve 38 to a port 41 of valve 18. Another port 42 communicates in that position with a port 43 for venting a line 45 through a line 68 provided with a throttle 44.

Line 45 extends to a port 54 of an ancillary valve 46 which is contained in box 50 and has a sliding body 47 wherein an end of piston rod 49, remote from arm 56, is loosely guided. Rod 49 is provided with a piston head 49' in a double-acting cylinder constituting therewith the servomotor 48. Opposite ends of servocylinder 48 have ports 58, 59 respectively connected to ports 51, 52 of ancillary valve 46 which has a venting port 53 connected to an outlet tube 69 with a throttle 64 and further has two inlet ports 65, 66 connected to high-pressure line 55. In the illustrated extreme position, into which the piston rob 49 is biased by a spring 57 bearing upon valve body 47, the gap 2 controlled by the corresponding bar 3 is entirely closed. At the same time, a spur 60 of lever 35 reverses a switch arm 61 to open the energizing circuit of drive motor 11 (FIG. 2) and close an energizing circuit for solenoid 33 (FIG. 1) to lift the latch 31, thereby letting the spring 28 swing the cylinder 6*b* away from its mate 6*a* until the arm 23*b* abuts a stop 67. The de-energization of motor 11 also arrests the corresponding transport and distribution rollers 4 and 5 which are coupled to each other through a gear transmission 39 and to shaft 22*a* through a belt transmission 62. After the hopper has been refilled and the float has risen to a level high enough to restore the switch arm 61 to its normal position, the operator may step on the pedal 27 to restore the working position of the cylinders.

It will be understood that the stopping of rollers 4, 5 and of the grinding cylinders upon a descent of float 16 to its lowest level can be accomplished by means other than the switch 61, e.g. via an additional pneumatic circuit.

The counterclockwise swing of lever 35 (FIG. 3) in response to a rise of float 16, overcoming the countervailing force of spring 36, gradually disaligns port 43 from port 42 and aligns it with port 41 to supply the port 54 of ancillary valve 46 with reduced air pressure, modulated by the position of lever 35, thus repressing the valve body 47 against the biasing force of spring 57 whereby, just as gradually, the right-hand part of cylinder 48 is vented through ports 58, 51, 53 while the left-hand part is being pressurized to swing the arm 56 clockwise with resulting widening of the corresponding gap 2. It will be noted that servomotor 48, through its piston rod 49 and spring 57, exerts a negative-feedback effect upon valve body 47 so as to stabilize its displacement. Naturally, the opposite movements occur as the hopper is being progressively depleted.

I claim:

1. In a grinding mill for converting farinaceous seeds into flour, including a hopper for receiving seeds to be ground, a pair of counterrotating cylinders for comminuting said seeds, and a transport roller for extracting the seeds from the hopper and delivering same to said cylinders, the combination therewith of:

a movable cover plate confronting said transport roller and defining therewith a gap of variable width through which the seeds must pass on their way to said cylinders:

detector means in said hopper for determining the seed level therein; and pneumatic means controlled by said detector means for displacing said cover plate to vary the width of said gap in a manner generally proportional to said seed level, said pneumatic means comprising:

a pilot valve responsive to said detector means, a servomotor fluidically controlled by said pilot valve to shift said cover plate with reference to said transport roller, said servomotor being constituted on a double-acting cylinder having a piston linked at one end with said cover plate, and an ancillary valve pneumatically settable by said pilot valve to direct high-pressure air selectively to a pair of ports at opposite ends of said cylinder.

2. The combination defined in claim 1 wherein said detector means comprises a float carried by the seeds in said hopper.

3. The combination defined in claim 1 wherein said ancillary valve has a body urged toward one position by a biasing spring and toward another position by air pressure modulated by said pilot valve.

4. The combination defined in claim 3 wherein said biasing spring is mechanically coupled with another end of said piston for exerting a negative-feedback effect upon the movement of said body.

5. The combination defined in claim 1 wherein said detector means comprises a float carried by the seeds in said hopper, said pilot valve having a body mechanically linked with said float for displacing said body against a countervailing spring force upon a rise in seed level.

6. The combination defined in claim 5 wherein said countervailing spring force is effective in a predetermined bottom position of said float to place said servomotor in a position in which said cover plate completely closes said gap.

7. The combination defined in claim 6 wherein said cylinders and said transport roller are provided with common drive means arrestable under the control of said float in said bottom position thereof, with concurrent separation of said cylinders from each other.

* * * * *